United States Patent [19]

Ippolito et al.

[11] 4,196,651

[45] Apr. 8, 1980

[54] NON-REDUNDANT GENERATOR UNLOCKING

[75] Inventors: Anthony C. Ippolito, DeKalb; William R. Hoskinson, Geneva, both of Ill.

[73] Assignee: The Wurlitzer Company, DeKalb, Ill.

[21] Appl. No.: 917,296

[22] Filed: Jun. 20, 1978

[51] Int. Cl.[2] ..... G10H 1/02; G10H 5/00

[52] U.S. Cl. ..... 84/1.01; 84/1.24

[58] Field of Search ..... 84/1.01, 1.22–1.24, 84/DIG. 4, DIG. 11

[56] References Cited

U.S. PATENT DOCUMENTS

| | | | |
|---|---|---|---|
| 3,816,635 | 6/1974 | Uetrecht | 84/1.01 |
| 3,828,109 | 8/1974 | Morez | 84/1.01 |
| 3,992,973 | 11/1976 | Howell | 84/1.23 |
| 4,056,995 | 11/1977 | Uetrecht | 84/1.01 |

OTHER PUBLICATIONS

James G. Simes, "An Almost Locked Oscillator for Electronic Music Synthesis", Journal of the Audio Engineering Society, Jun. 1977, vol. 25, No. 6, pp. 394–395.

*Primary Examiner*—S. J. Witkowski

*Attorney, Agent, or Firm*—Trexler, Wolters, Bushnell & Fosse, Ltd.

[57] ABSTRACT

An electronic organ or the like is provided with a plurality of frequency generators greatly less than the number of keys on the organ. Each generator is capable of producing an electrical oscillation of proper frequency for any musical note on the organ keyboard. The frequency generators are assigned to the desired frequency called for by depression of any key. Pulses are dropped, preferably in different numbers, from the frequency generators to avoid locking of oscillators in any musically desirable relationship to one another, including octave or harmonic relation.

12 Claims, 7 Drawing Figures

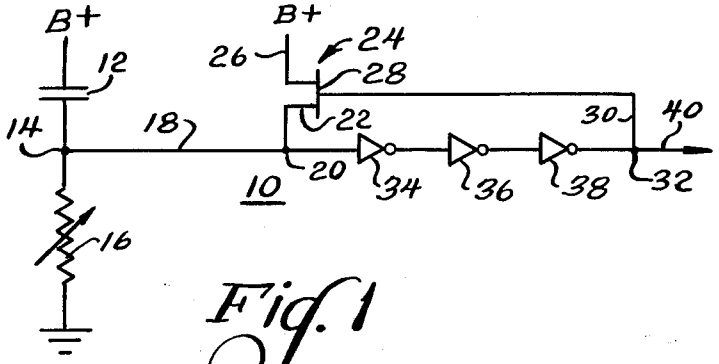
Fig. 1
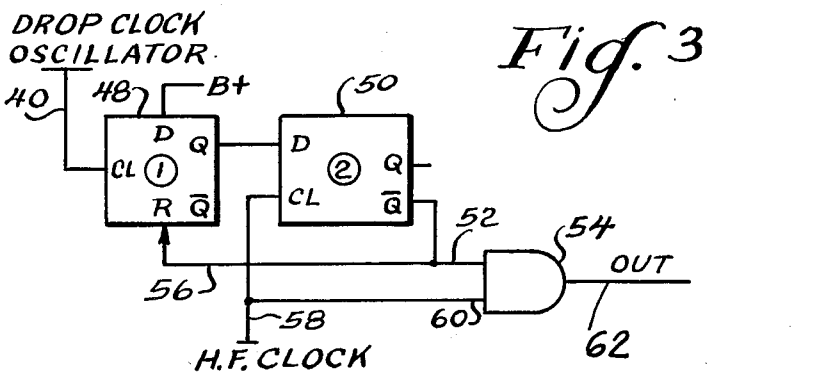
Fig. 3
Fig. 2
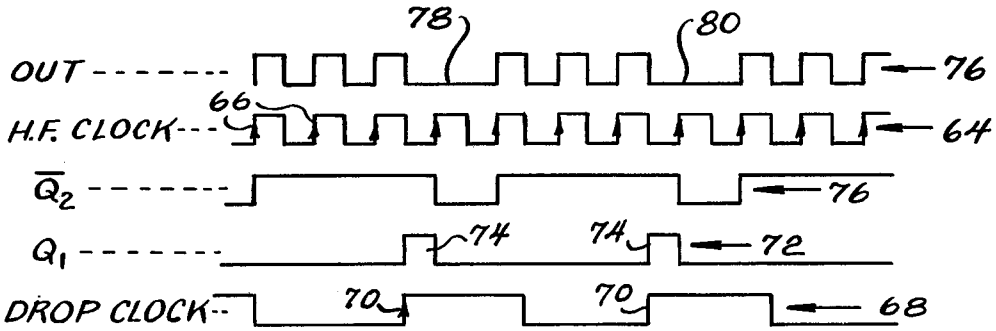
Fig. 4

NON-REDUNDANT GENERATOR UNLOCKING

BACKGROUND OF THE INVENTION

Electronic organs have been known for many years. Early electronic organs used various electrical-mechanical devices for generating electrical oscillations corresponding to musical tones. Various types of electronic oscillators have also been used to provide such oscillations. Some organs have used an independent oscillator or generator for each tone. In the past the use of such independent oscillators has been quite expensive, and for cost saving reasons it has become common practice to provide twelve oscillators to provide the semitones of the top octave, and to use divide-by-two circuits to porvide the tones in lower octaves. More recently it has become well known to use a single radio frequency oscillator with divider circuits of different divider ratios to produce the top octave of tones. This system is sometimes known as a top octave synthesizer (TOS). Strings of divide-by-two circuits have been used to provide the notes in lower octaves of the organ.

With the advent of reliable large scale integrated circuit (LSI) chips efforts have been made to construct electronic organs utilizing digital circuits. It is relatively easy to construct LSI chips that will handle digital circuits whereas it is relatively very difficult to utilize analog circuits with such LSI chips.

With a top octave synthesizer approach all of the generators or oscillators have in most instances been locked together is predetermined relation, due to their operation by the single radio frequency oscillator. The approach of utilizing twelve oscillators with divide-by-two circuits has avoided locking notes together within an octave, but has caused octave locking.

The patent art has recognized the undesirability of octave locked oscillators. For example see Eugene S. Morez U.S. Pat. No. 3,828,109. Certain of the claims of this Morez patent were lost to Dale M. Uetrecht pending application for U.S. Pat. Ser. No. 563,431, filed Mar. 31, 1975, and now U.S. Pat. No. 4,056,995. During the interference proceeding Uetrecht was accorded the benefit of his earlier U.S. Pat. No. 3,816,635, and attention therefore should be directed to both Uetrecht patents. The work of both Uetrecht and Morez appears to have been based on an article "Many Digital Functions Can Be Generated With A Rate Multiplier" by Richard Phillips published in *Electronic Design Magazine dated Feb.* 1, 1968, pages 82–85. Both Uetrecht and Morez adopted a policy of dividing by some factor not quite equal to two in order to unlock footages of notes that would otherwise have exactly a two to one relation.

OBJECTS AND BRIEF DESCRIPTION OF THE PRESENT INVENTION

It is an object of the present invention to provide an electronic organ or the like with a relatively small number of non-redundant frequency synthesizers in which each synthesizer is slightly de-tuned from its theoretically exact frequency with different frequency generators being differently de-tuned whereby each frequency generator is unlocked relative to every other frequency generator.

A further object of the present invention is to provide an electronic organ or the like having a relatively small plurality of unlocked generators derived from a single high frequency clock. Whereby related frequencies may beat with one another but will never cancel.

Still another object of the present invention is to provide a relatively small plurality of generators, each of which is assignable to any of the notes of the organ keyboard with which they are associated, wherein the ratio between any notes played by the organist is different from one note to another relative to the ratio of the same notes on a true tempered scale; i.e., the ratios between any two adjacent notes are never the twelfth root of two.

In attaining the foregoing and other objects of the present invention the present electronic organ or the like is provided by way of example with three (or five in one example) frequency generators for one keyboard of an organ. Each frequency generator is capable of being assigned to generate the frequency of any note of the keyboard with which it is associated. Each generator is controlled by a common clock, but pulses are dropped from the clock differently to each frequency generator so that each frequency generator is slightly de-tuned from its nominal frequency. Each frequency generator is de-tuned slightly differently, and any generator can be assigned to any key, whereby there is a degree of randomicity of frequency for any note. As a result of the foregoing no generator ever bears a fixed relation to any other generator so as to prevent harmonic locking, or locking together in other undesired frequency ratios, such as three/two or four/three.

THE DRAWINGS

The invention best will be understood from the following description when taken in connection with the accompanying drawings wherein:

FIG. 1 is an electrical wiring diagram showing a drop clock oscillator in accordance with the present invention;

FIG. 2 is a wave diagram showing the wave generated by the oscillator of FIG. 1;

FIG. 3 is a simple electrical wiring diagram showing the principles of pulse dropping as used in the present invention;

FIG. 4 is a wave diagram corresponding to the circuit of FIG. 3;

DETAILED DISCLOSURE

Figure 5:
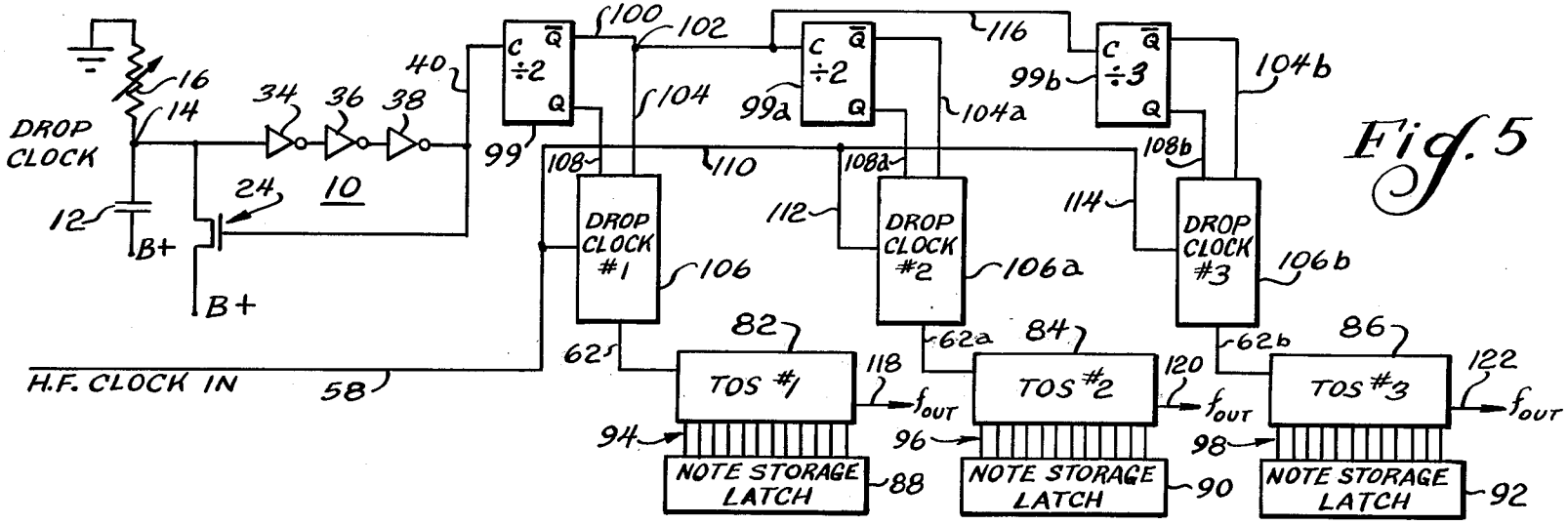
FIG. 5 is an electrical diagram illustrating the principles of the present invention in connection with three frequency generators.

A drop clock oscillator 10 is shown in FIG. 1 and includes a capacitor 12 having one side or plate thereof connected to B+ and the other side or plate thereof connected to a junction 14. A variable resistor 16 is connected between the junction 14 and ground. It should be noted that wherever mention is made of "ground" herein that the parts are on a large scale integrated circuit (LSI) chip and that "ground" is used as a reference potential. It may actually be at ground potential, or at a fixed positive or negative voltage maintained as a reference potential.

Connection is made from the junction 14 by way of a conductor 18 to a junction 20 to which is connected to source 22 of a field effect transistor 24. The drain of this transistor is connected to B+, while the control element or gate 28 is connected by a conductor 30 to a junction 32. Connection is made from the junction 20 to the junction 32 through a series of three inverters, respectively 34, 36, and 38. The output is taken from the oscillator at 40.

The wave shape appearing at junction 14 is shown in FIG. 2, comprising substantially a sawtooth wave 42 consisting of alternate capacitor charge curves 44 and capacitor discharge curves 46. The output wave at 40 is a rectangular wave since the inverters act as saturation amplifiers.

A simple exemplification of the use of the drop clock oscillator in the present invention is illustrated in FIG. 3. The drop clock oscillator 40 is connected to the clock input of a D flip-flop 48. B+ is connected to the D input of this flip-flop. Connection is made from the Q output to the D input of another D flip-flop 50. The $\overline{Q}$ output of the D flip-flop 48 is not connected.

The Q output of the flip-flop 50 is not connected, while the $\overline{Q}$ output thereof is connected to a line 52 which serves as one input of a two input AND gate 54, and which is also returned as 56 to the reset input of the first flip-flop 48. A high frequency clock connection 58 leads to the clock input of the D flip-flop 50, and also serves as the second input 60 for the two input AND gate 54. The output of the AND gate is identified as 62.

The wave diagrams of FIG. 4 should be regarded as exemplary rather than as actual, since the true frequencies are not readily adaptable to a patent drawing. For example, the high frequency clock may be on the order of four MHz, while the frequency of the drop clock may be on the order of five KHz. Both waves of are approximately 50% rectangular waveform.

Thus, the high frequency clock wave is shown at 64, with the rising edge of each positive pulse having an arrowhead 66 indicating the rise. The present invention comprises a part of an LSI chip, as indicated earlier, and is intended for use in a modular, expandable organ system as disclosed and claimed in the copending application of Harold O. Schwartz, Dennis E. Kidd and William R. Hoskinson filed June 20, 1978 under Ser. No. 917,310 assigned to the same assignee as the present application, the Wurlitzer Co., and it will be understood that the high frequency clock wave 64 appearing on the input lead 58 is the same high frequency clock used throughout the organ.

The drop clock wave is shown at 68, and is of a 50% duty cycle rectangular wave of lower frequency than the high frequency clock wave. Again the rising edge of each positive pulse is identified by an arrowhead 70. The Q output of the first flip-flop 48 is illustrated at 72 and comprises a rectangular waveform of substantially less than 50% duty cycle. A positive pulse 74 appears each time there is a rising pulse of the drop clock into the clock input of this flip-flop. The Q output of the flip-flop 50 is shown at 76, and also comprises a rectangular wave, this one being of considerably greater than 50% duty cycle.

The output of the circuit at 62 comprises the rectangular wave 76 which is almost identical with the high frequency clock wave 64, except that at predetermined intervals a pulse is dropped as at 78 and 80.

In accordance with one embodiment of the invention there are three frequency generators to an LSI chip, each of which includes a top octave synthesizer (TOS), respectively 82, 84 and 86 in FIG. 5. When any note is played on the keyboard of the organ incorporating the present invention, as in the ogan system of the aforesaid Schwartz, Kidd, and Hoskinson copending application, the first available top octave synthesizer has a frequency assigned to it from a note storage latch, respectively 88, 90, and 92. The first storage latch 88 controls the top octave synthesizer 82 through twelve parallel lines 94. Like sets of twelve parallel lines 96 and 98 respectively control the top octave synthesizers 84 and 86 from the note storage latches 90 and 92.

The note storage latches effect generation of the proper frequencies by the corresponding top octave synthesizers in accordance with multiplexed data fed to the note storage latch, and this is disclosed in the copending application of Harold O. Schwartz and Dennis E. Kidd field June 20, 1978 under Ser. No. 917,313 assigned to the same assignee as the present application, The Wurlitzer Co. Each TOS 82, 84, and 86 therefore puts out a frequency related to a note played on the organ and related directly to the clock frequency into the TOS.

Certain portions of FIG. 5 are similar to FIGS. 1 and 3, and the same numerals are used to avoid duplication of discussion. The input 40 omprising the output of the drop clock oscillator 10 is applied to the clock input of a J-K flip-flop 99 used as a divide-by-two circuit. The Q output is applied to a conductor 100 having a junction 102. A conductor 104 leads from the junction 102 to drop clock number 1 identified by numeral 106. This drop clock corresponds approximately to FIG. 3, whereby the output at 62 is the same as the output in FIG. 3. The Q output of the flip-flop 99 also is connected by a conductor 108 to the drop clock 106. Thus, the output 62 thereof comprises the frequency of the high frequency applied at 58 less the frequency of the drop clock as applied at 104 and 108. By way of specific example the high frequency clock runs at 4 MHz while the drop clock frequency appearing on lines 104 and 108 is five KHz. Thus, the output at 62 is 4 MHz-5 KHz, viz. 3.995 MHz.

Connection is made from the junction 102 to another divide-by-two flip-flop circuit 99A, having an output on lines 104A and 108A at half the frequency on the lines 104 and 108, namely $2\frac{1}{2}$ KHz. A conductor 110 leads from the high frequency clock input at 58 to a branch conductor 112 connected to the second drop clock 106A. Thus, the output frequency at 62A into the TOS 84 is 4 MHz-$2\frac{1}{2}$ KHz, namely 3.9975 MHz.

Similarly a branch 114 from the conductor 110 leads to the input of the third drop clock 106B. It will be noted that a connector 116 branches from the line 100 and bypasses the flip-flop 99A and leads to the input of a divide-by-three circuit 99B. Hence, the output appearing on lines 104B and 108B is $1\frac{2}{3}$ KHz. Thus, the output at 62B from the third drop clock 106B is 4 MHz—$1\frac{2}{3}$ KHz, namely 3.998333 MHz.

From the foregoing it will be apparent that the respective outputs 118, 120, and 122 of the top octave synthesizers 82, 84, and 86 will be related to three slightly different input clock frequencies. Each frequency out will thus vary somewhat from its nominal frequency. Assignment of generators is random-like, since whenever a key is closed it is the next available generator that is assigned to that key. Hence, not only is each of the three outputs off somewhat from its nominal frequency, but may be off differently on different occasions since each generator is capable of playing any note. Thus, every note in the organ is unlocked from every other note.

Figure 6:
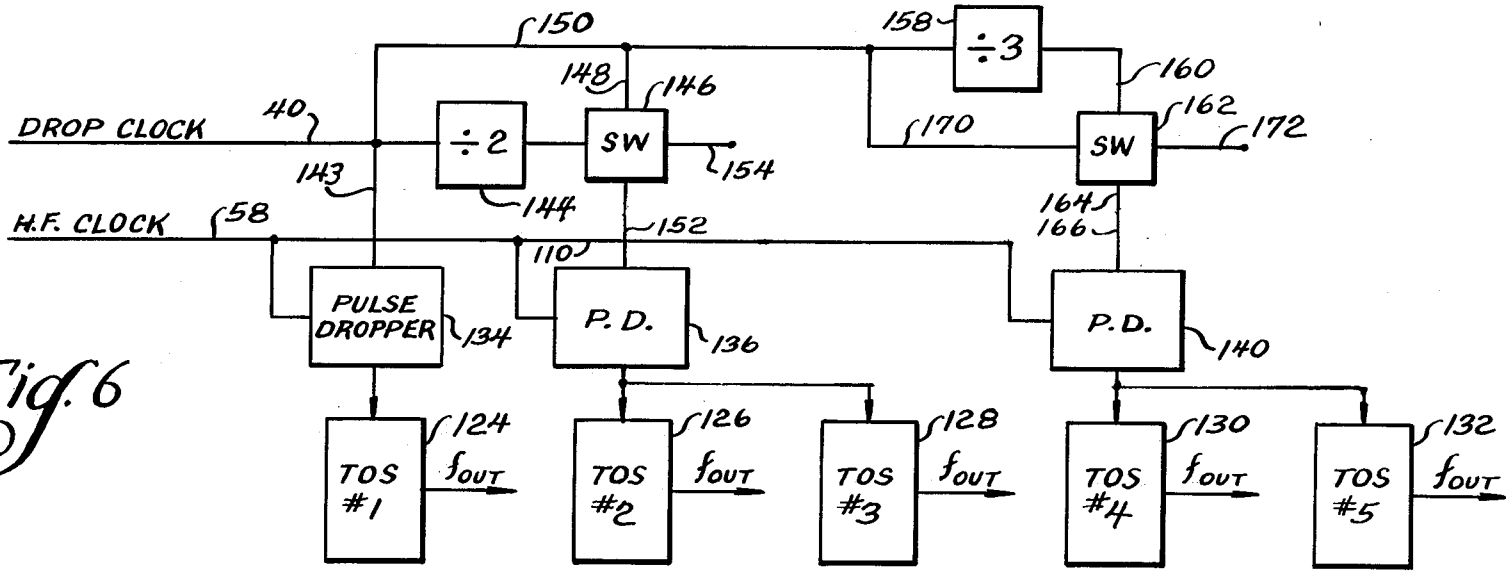
FIG. 6 is another electrical wiring diagram somewhat similar to FIG. 5 and further illustrating the principles of the present invention.

In accordance with another variation of the present invention it is desired to provide five frequency generators on a single LSI chip. (With reference to the Schwartz, Kidd, and Hoskinson copending application previously mentioned, the previous embodiment is on a B-2 chip, while the embodiment about to be described is on the B-4 chip.) Thus, in FIG. 6 there are five top octave synthesizers (TOS) 124, 126, 128, 130, and 132. Each is provided with a clock input from a pulse dropper corresponding to the drop clock of FIG. 5, the respective pulse droppers to top octave synthesizers being 134, 136, and 140. The high frequency clock is again is indicated at 58 connected to a bus 110. Branch lines from the bus respectively feed the pulse droppers.

The drop clock frequency again is indicated as an input at 40, and in this instance the frequency is not divided for the first pulse dropper, but is transmitted directly by a conductor 143 to the pulse dropper 134. Again, with a four MHz input at 58 and a five KHz input at 40, the output from the pulse dropper 134 to the TOS 124 will be four MHz–five KHz, namely 3.995 MHz.

The drop clock frequency from 40 is passed by a divide-by-two circuit 144 and to a switch 146. The switch has another input at 148 from a bus 150 connected to the drop clock input 40. The output 152 of the switch 146 leads directly to the second pulse dropper 136. An input connection 154 to the switch is a control, so that the organist can control the operation of the switch. Normally the switch is such that the frequency divided by the circuit 144 is connected to the line 152, whereby the frequency supplied by the second pulse dropper 136 to TOS #2 126 and TOS #3 128 will be four MHz–$2\frac{1}{2}$ KHz. An alternative will be set forth later.

The bus 150 leads to a divide-by-three circuit 158 having an output 160 leading to a switch 162, and normally connected through the switch to an output 164 which leads to pulse dropper 140.

There is also a branch conductor 170 from the bus 150 leading to another input to the switch 162. A control 172 is connected to the switch 162. Thus, normally both the fourth and fifth top octave synthesizers are provided with the same input clock frequency, namely 4 MHz–$1\frac{2}{3}$ KHz.

In accordance with the foregoing the second and third top octave synthesizers 126, and 128 will be in a locked relationship, but unlocked relative to the top octave synthesizer 124, and the top octave synthesizers 130 and 132. Similarly, the top octave synthesizers 130, and 132 will be locked relative to one another, but not relative to the first three top octave synthesizers 124, 126, and 128.

The control line 154 is capable of operating the switch 146 so that the non-divided drop clock frequency at 148 will appear on the output 152. At the same time the control 172 to the switch 162 will connect the undivided drop clock frequency at 170 to the output 164. This will result in locking of all five generators together, but with periodic detuning in accordance with the drop clock in order to produce a vibrato effect by altering the frequency of the top octave synthesizers in unison.

Figure 7:
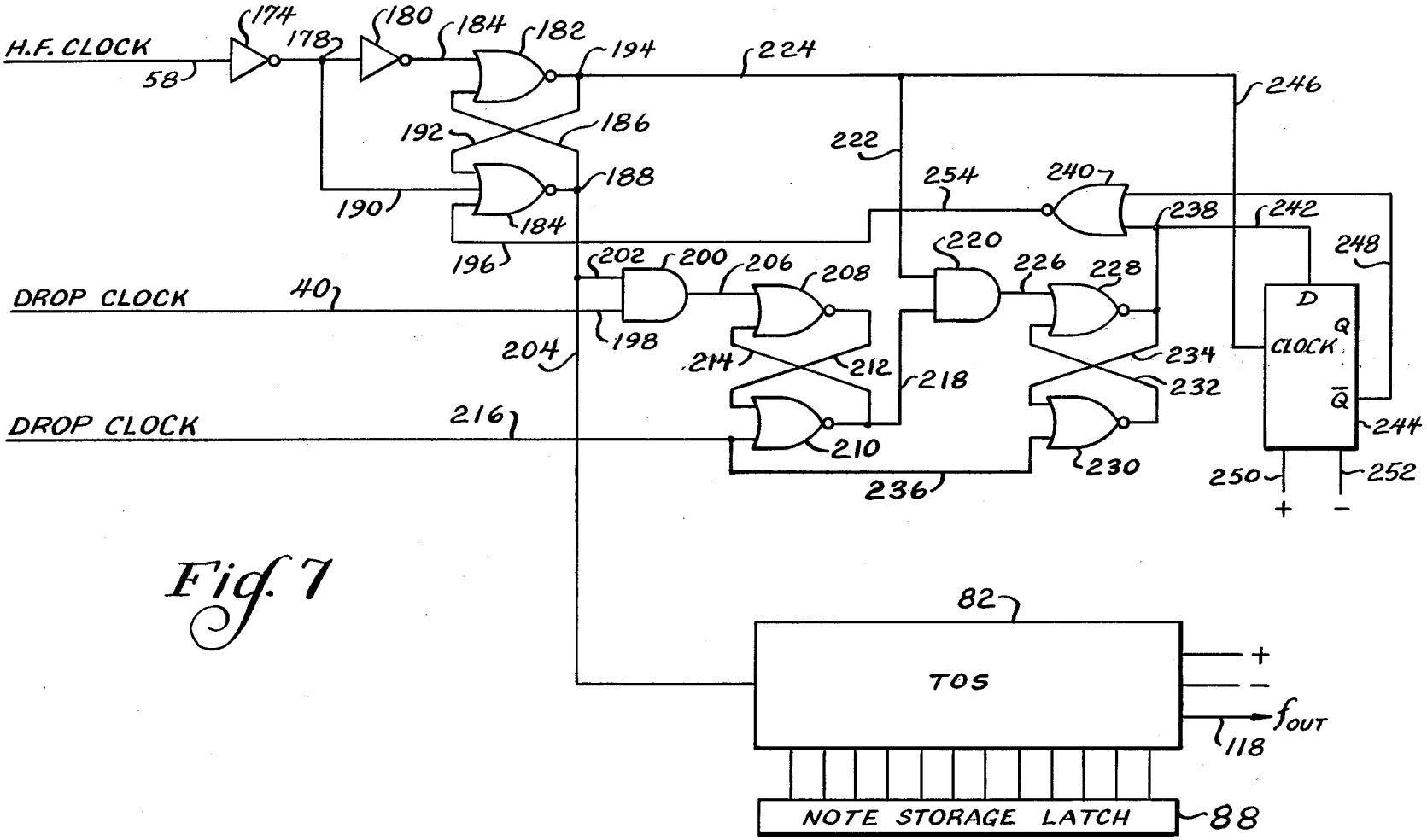
FIG. 7 is an electrical wiring diagram generally similar to FIG. 3 but showing a specific implementation with regard to the present invention.

A practical exemplification of the drop clock circuit as it actually appears on an LSI chip is shown in FIG. 7. The top octave synthesizer 82 remains the same as one of the top octave synthesizers in FIG. 5, being controlled by the notes storage latch 88 and having an output frequency at 118.

The high frequency clock input is again on the line 58 and is connected through an inverter 174 to a junction 178 which leads to another inverter 180. Two NOR gates 182 and 184 are interconnected in flip-flop fashion, one input to the NOR gate 182 being at 184 from the inverter 180. The NOR gate 182 is a two input NOR gate and the second input thereof is connected at 186 from a junction 188 at the output of the NOR gate 184. The NOR gate 184 is a three input NOR gate, and one connection 190 is taken from the junction 178. Another input is taken at 192 from the output of the NOR gate 182 at 194. The third input 196 of the NOR gate 184 will be discussed later.

The drop clock input again appears on conductor 40 and leads to one input 198 of a two input AND gate 200. The second input 202 is taken from a line 204 connected to the output 188 of the NOR gate 184. The line 204 continues as an input to the top octave synthesizer 82.

It should be noted at this point that only one top octave synthesizer and operating connections are shown in FIG. 7, but that parts would be triplicated as in FIG. 5, for example.

The output 206 of the AND gate 200 serves as one input to a two input NOR gate 208 cross connected with another two input NOR gate 210. The output of the NOR gate 208 is connected at 212 to one input of the NOR gate 210, while the output of the NOR gate 210 is connected back at 214 to the second input of the NOR gate 208. The second input to the NOR gate 210 comprises the $\overline{\text{drop clock}}$.

The output of the NOR gae 210 is connected at 218 to one input of a two input AND gate 220. The second input to this AND gate is a conductor 222 leading to a conductor 224 from the output 194 of the NOR gate 182.

The output 226 of the AND gate 220 is connected to one input of a two input NOR gate 228 cross connected with another two input NOR gate 230. The output of the NOR gate 230 is cross connected at 232 to the second input of the NOR gate 228. One input to the NOR gate 230 comprises a cross connection 234 from the output of the NOR gate 228. The second input to the NOR gate 230 comprises a conductor 236 leading from the input 216.

The output of the NOR gate 228 leads to a junction 238, and from there to one input of a two input NOR gate 240. The junction 238 also is connected by a conductor 242 to the D or data input of a D flip-flop 244. The clock input of the flip-flop 244 comprises a conductor 246 leading from the conductor 224. The Q output of the flip-flop 244 is not used, but the Q is connected at 248 to the second input of the NOR gate 240. Positive and negative potential are applied to the flip-flop 244 as indicated at 250 and 252.

The output 254 of the NOR gate 240 leads back to the input 196 of the NOR gate 188. A rising edge of the drop clock at 40 produces a 1 at 198 into the AND gate 200. There is also a 1 in at 204 resulting from operation of the high frequency clock, and there is therefore a 1 out at 206 which forces the NOR gate 208 to a 0 output at 212. This 0 comprises then an input to the NOR gate 210 which receives another 0 on conductor 216 from the $\overline{\text{drop clock}}$ which thus produces a 1 out of the NOR gate 210 on the cross connection 214 which thus latches NOR gate 208.

The 1 output from the NOR gate 210 provides a 1 input to the AND gate 220. On the next rise of the high frequency clock there will be another 1 into the AND gate 220, thus to produce a 1 out at 226.

The NOR gates 228 and 230 work in a fashion similar to the NOR gates 208 and 210 and a 0 is outputed by the NOR gate 228 and a 1 by the NOR gate 230. There was previously a 1 out of the NOR gate 228. A 0 is produced at the $\overline{Q}$ output 248 of the flip-flop 244, thus two zeros appear on the inputs to NOR gate 240 and a 1 appears on the output 254. This 1 blocks the NOR gate 184 and disables the high frequency clock input. Thus there is a 0 out of the NOR gate 184 appearing on the line 204 to the top octave synthesizer 82. With the next 0 on the high frequency clock input 58 the $\overline{Q}$ output 248 of the flip-flop 244 goes to 1 since there are at that time two 0's into the NOR gate 182 with a resulting one on the line 224, 246. The 0 to 1 transition clocks the flip-flop 244 so that a 1 now appears on the $\overline{Q}$ output 248 which causes the line 254 to go to 0 whereby the NOR gate 184 returns to normal operation.

It will now be seen that there have been disclosed electronic circuits for dropping different numbers of pulses from a high frequency clock signal used to clock frequency generators corresponding to musical tones. Thus, each tone developed will differ somewhat from its nominal frequency, each generator differing by a different amount so that in one form of the invention no generator is locked to any other generator. More than three generators readily are obtained by operating two or more of the present LSI chips as disclosed in the aforesaid copending patent application of Schwartz, Kidd, and Hoskinson, and as also disclosed in the aforesaid copending application of Harold O. Schwartz and Dennis E. Kidd filed June 20, 1978 under Ser. No. 917,313 assigned to the same assignee as the present application, The Wurlitzer Co. In another embodiment of the invention certain generators may be locked together and others unlocked, the overall effect being one of unlocked generators. The unlocking of the generators is important in that beats are produced which are typical of natural instruments, thereby making the tones of an organ utilizing the present system more realistic than is possible with locked oscillators, and much more economical than the use of individual generators for every key. Harmonically related frequencies may beat together, but will never cancel. The ratio between any two adjacent notes is never the twelfth root of two. Any chord played with the present system will be either slightly augmented or diminished depending on the resultant differential frequencies between notes. Precise ratios such as 3/2 or 4/3 are avoided as well as precise harmonic ratios, whereby desired beats are obtained which add life and movement to a chord played.

The specific examples of the invention as herein shown and described are for illustrative purposes only. Various changes will no doubt occur to those skilled in the art and will be understood as forming a part of the present invention insofar as they fal within the spirit and scope of the appended claims.

The invention is claimed as follows:

1. The combination for use in an electronic musical instrument comprising a first frequency synthesizer capable of synthesizing a first frequency corresponding to any note of the gamut of said instrument, control means connected to said first frequency synthesizer to cause said first frequency synthesizer to produce said first frequency, a second frequency synthesizer capable of synthesizing a second frequency corresponding to any note of said gamut, said control means being connected to said second frequency synthesizer to cause said second frequency synthesizer to produce said second frequency, said control means including a source of clock pulses and at least two circuit means for connecting said source of clock pulses respectively to said first and said second frequency synthesizers, at least one of said connecting circuit means including means for altering the number of clock pulses applied to the respective frequency syntheizer to prevent locking of frequencies of said synthesizers within said gamut.

2. The combination as set forth in claim 1 wherein both of said connecting circuit means alter the number of clock pulses, but one alters the number of clock pulses a different degree than the other.

3. The combination as set forth in claim 1 wherein the means for altering the number of clock pulses comprises means for dropping selected pulses.

4. The combination as set forth in claim 1 wherein both connecting circuit means include means for altering the number of clock pulses, and wherein the altering means comprise means for dropping selected pulses, one of said altering means dropping more pulses than the other.

5. The combination for use in an electronic musical instrument comprising a first frequency synthesizer capable of synthesizing a first frequency corresponding to any note of the gamut of said instrument, control means connected to said first frequency synthesizer to cause said first frequency synthesizer to produce said first frequency, a second frequency snythesizer capable of synthesizing a second frequency corresponding to any note of said gamut not produced by said first frequency synthesizer, said control means being connected to said second frequency synthesizer to cause said second frequency synthesizer to produce said second frequency, said control means including a source of reference frequency and at least two circuit means connecting said source of reference frequency respectively to said first and said second frequency synthesizers, at least one of said connecting circuit means including means for altering the reference frequency applied to the respective frequency synthesizer to prevent locking of frequencies of said synthesizers within said gamut.

6. The combination as set forth in claim 5 wherein the means for altering the reference frequency comprises means for lowering the reference frequency.

7. The combination as set forth in claim 6 wherein the means for altering the reference frequency includes means for removing a cycle therefrom from time to time.

8. The combination for use in an electronic musical instrument comprising a first frequency synthesizer capable of synthesizing a first frequency corresponding to any note of the gamut of said instrument, control means connected to said first frequency synthesizer to cause said first frequency synthesizer to produce said first frequency, a second frequency synthesizer capable of synthesizing a second frequency corresponding to any note of said gamut not produced by said first frequency synthesizer, said control means being connected to said second frequency synthesizer to cause said second frequency synthesizer to produce said second frequency, said control means including a source of clock pulses, and at least two circuit means for connecting said source of clock pulses respectively to said first and said second frequency synthesizers, at least one of said connecting circuit means including means for dropping a pulse from time to time from said clock pulses applied to the respective frequency synthesizer to prevent locking of frequencies of said synthesizers within said gamut.

9. The combination for use in an electronic musical instrument comprising a first frequency synthesizer capable of synthesizing a first frequency corresponding to any note of the gamut of said instrument, control means connected to said first frequency synthesizer to cause said first frequency synthesizer to produce said first frequency, a second frequency synthesizer capable of synthesizing a second frequency corresponding to any note of said gamut not produced by said first frequency synthesizer, said control means being connected to said second frequency synthesizer to cause said second frequency synthesizer to produce said second frequency, said control means including a source of high frequency clock pulses, a source of drop clock pulses and at least two gate means connecting said source of high frequency clock pulses respectively to said first and said second frequency synthesizers and circuit means connecting said source of drop clock pulses to at least one of said connecting gate means, said last mentioned connecting circuit means combining the high frequency clock pulses and the drop clock pulses to drop a pulse from said high frequency clock pulses from time to time to prevent locking of frequencies of said synthesizers within said gamut.

10. The combination for use in an electronic musical instrument comprising a first frequency synthesizer capable of synthesizing a frequency corresponding to any note of the gamut of said instrument, first control means connected to said first frequency synthesizer, a second frequency synthesizer capable of synthesizing a second frequency corresponding to any note of said gamut not produced by said first frequency synthesizer, second control means connected to said second frequency synthesizer to produce said second frequency, a third frequency synthesizer capable of synthesizing a third frequency corresponding to any note of said gamut not produced by said first and said second frequency synthesizers, third control means connected to said third frequency synthesizer to produce said third frequency, said first, second and third control means including a source of high frequency clock pulses, at least three circuit means for connecting said source of clock pulses respectively to said frequency synthesizers, a source of drop clock pulses, first divider means connected to said source of drop clock pulses for dividing the frequency thereof by a first predetermined ratio, second divider means connected to said first divider means for again dividing the frequency of drop clock pulses by a second predetermined ratio, third divider means connected to said first divider means for again dividing the frequency of the drop clock pulses by a third ratio which is different from said second ratio, each of the three circuit means respectively connecting the high frequency source to said three frequency synthesizers comprising pulse dropping means, and means respectively interconnecting the three divider means to the pulse dropping means to effect dropping of pulses at predetermined intervals and thereby to prevent locking of frequencies of said synthesizers.

11. The combination for use in an electronic musical instrument comprising a first frequency synthesizer capable of synthesizing a first frequency corresponding to any note of the gamut of said instrument, control means connected to said first frequency synthesizer to cause said first frequency snythesizer to produce said first frequency, a second frequency synthesizer capable of synthesizing a second frequency corresponding to any note of said gamut, said control means being connected to said second frequency synthesizer to cause said second frequency synthesizer to produce said second frequency, said control means including a source of clock pulses, a plurality of circuit means for respectively connecting said source of clock pulses to said frequency synthesizers, at least some of said connecting circuit means including means for altering the number of clock pulses applied to the respective frequency synthesizers, and further control means interconnected with said connecting means to selectively effect altering of the number of clock pulses applied to each said plurality of frequency synthesizers to the same extent or to effect altering the number of clock pulses applied to some of said frequency synthesizers by different extents than to others of said frequency synthesizers.

12. The combination for use in an electronic musical instrument comprising a first frequency synthesizer capable of synthesizing a first frequency corresponding to any note of the gamut of said instrument, a control means connected to said first frequency synthesizer to cause said first frequency synthesizer to produce said first frequency, a second frequency synthesizer capable of synthesizing a second frequency corresponding to any note of said gamut not produced by said first frequency synthesizer, said control means being connected to said second frequency synthesizer to cause said second frequency synthesizer to produce said second frequency, said control means including a source of high frequency clock pulses, a plurality of circuit means for connecting said source of clock pulses respectively to said frequency synthesizers, a source of drop clock pulses having a predetermined frequency, divider means connected to said source of drop clock pulses for producing a divided drop clock frequency, said connecting circuit means including means responsive to said drop clock pulses for dropping pulses from said high frequency clock pulses at predetermined times, first means interconnecting said drop clock pulse source to at least one of said pulse dropping means, second interconnecting means connecting the divided output of said divider means with at least one of said pulse dropping means, an additional one of said pulse dropping means being connected to one of said first and second interconnecting means whereby two of said pulse dropping means will drop the same number of pulses.

* * * * *

UNITED STATES PATENT AND TRADEMARK OFFICE

CERTIFICATE OF CORRECTION

PATENT NO. : 4,196,651

DATED : April 8, 1980

INVENTOR(S) : Anthony C. Ippolito and William R. Hoskinson

It is certified that error appears in the above-identified patent and that said Letters Patent are hereby corrected as shown below:

Column 1, line 32, change "is" to --in--;

Column 3, line 57, change "Q" to --$\overline{Q}$--;

Column 4, line 26, change "Q" to --$\overline{Q}$--;

Column 6, line 34, change "gae" to --gate--;

Column 6, line 54, change "Q" to --$\overline{Q}$--.

Signed and Sealed this

*Fifth* Day of *August 1980*

[SEAL]

*Attest:*

SIDNEY A. DIAMOND

*Attesting Officer*

*Commissioner of Patents and Trademarks*